US005309650A

United States Patent [19]

Josefsson et al.

[11] Patent Number: 5,309,650

[45] Date of Patent: May 10, 1994

[54] METHOD AND APPARATUS FOR VENTILATING A PAINT BAKING OVEN

[75] Inventors: Leif E. B. Josefsson, Sterling Heights, Mich.; Anders P. A. T. Persson, Vaxjo, Sweden

[73] Assignee: ABB Flakt, Inc., Auburn Hills, Mich.

[21] Appl. No.: 751,716

[22] Filed: Aug. 29, 1991

[51] Int. Cl.[5] ..... F26B 3/04

[52] U.S. Cl. ..... 34/493; 34/443; 34/227; 34/418

[58] Field of Search ..... 34/18, 60, 16, 17, 39, 34/41, 12, 155, 208, 22, 26, 227; 454/50, 53, 54, 55

[56] References Cited

U.S. PATENT DOCUMENTS

| | | | |
|---|---|---|---|
| 2,939,222 | 6/1960 | Svavar et al. | 34/18 |
| 3,474,544 | 10/1969 | Holden, Jr. et al. | 34/18 X |
| 4,287,671 | 9/1981 | Koch, II | 34/18 X |
| 4,336,279 | 6/1982 | Metzger | 34/18 X |
| 4,359,826 | 11/1982 | Rounsley | 34/18 X |
| 4,513,516 | 4/1985 | Björnberg | 34/41 |
| 4,635,381 | 1/1987 | Hubbert | 34/54 |
| 4,731,016 | 3/1988 | Dixon | 34/242 X |
| 4,785,552 | 11/1988 | Best | 34/30 |
| 4,890,394 | 1/1990 | Troetscher | 34/17 X |
| 4,936,025 | 6/1990 | Heikkilä | 34/18 |
| 4,979,315 | 12/1990 | Pierson | 34/60 X |
| 5,113,600 | 5/1992 | Telchuk | 34/218 X |
| 5,178,679 | 1/1993 | Josefsson | 454/53 X |

FOREIGN PATENT DOCUMENTS

0420554A1 9/1990 European Pat. Off. .

*Primary Examiner*—Martin P. Schwadron
*Assistant Examiner*—Kevin L. Lee
*Attorney, Agent, or Firm*—Harness, Dickey & Pierce

[57] ABSTRACT

A paint baking oven utilizes air flow throughout the oven to ventilate solvents and/or resins which evaporate off during the paint baking process. Air is continuously introduced through air seals located along the paint baking oven at various points. This ventilation air is directed toward the center of the paint baking oven where it is exhausted at a rate proportional to the rate at which the ventilation air is introduced into the paint baking oven. Removing the solvent and/or resin laden air from the paint baking oven results in a more desirable final finish on the component being baked.

14 Claims, 2 Drawing Sheets

METHOD AND APPARATUS FOR VENTILATING A PAINT BAKING OVEN

BACKGROUND OF THE INVENTION

1. Field of the Invention

This invention relates to paint baking ovens. More particularly, the invention relates to a method and apparatus for ventilating paint baking ovens.

2. Description of Related Art

Paint baking ovens are used throughout the manufacturing industry to bake the paint or coating applied to various articles such as automobile components. Such paint baking ovens often have conveyors or similar devices for bringing the component to be baked into the paint baking oven and then carrying the component through the various sections or zones of the paint baking oven. While the component is within the paint baking oven, ventilation air is introduced for a variety of reasons. Heated ventilation air mixed with recirculation air is often blown over the surface of the component passing through the paint baking oven to achieve an even temperature over the surface of the component. Obtaining an even temperature over the surface of the component helps insure a consistent baking which in turn results in a more desirable finish.

Ventilation air is also useful to carry the evaporated solvents and/or resins which are driven from the component during the paint baking process out of the paint baking oven.

Designers of paint baking ovens have traditionally attempted to deal with improving the final appearance of the paint or finish applied to the component by providing a ventilation system which helps prevent impurities, such as solvents and resins, from settling or condensing within the paint baking oven.

None of the art known to applicants suggests introducing all of the heated fresh ventilation air into the paint baking oven at the air inlet seals to reduce the occurrence of solvent condensation in the vicinity of those seals within the paint baking oven.

Additionally, none of the art presently known to the applicants suggests introducing heated fresh ventilation air above the oven zone equilibrium point in a camel-back paint baking oven such that the heated fresh ventilation air draft naturally will move upwardly to a succeeding oven zone carrying evaporated solvents and resins toward an exhaust system.

SUMMARY OF THE INVENTION

Accordingly, the invention provides a paint baking oven having an outer ceiling and a floor interconnected by two side walls to define a tunnel with air sealed entrance and exit ends, with articles to be baked moving longitudinally along and through the tunnel from the entrance end to the exit end. Air inlets for introducing air into the paint baking oven are provided at the air seals. Air exhausts extend from the paint baking oven at a preselected location along the tunnel between the entrance and exit ends and is operative to withdraw solvent and/or resin laden air from the paint baking oven.

It is a feature of this invention to provide heated fresh ventilation air into the paint baking oven at the air seals to prevent condensation of solvents and/or resins within the paint baking oven.

It is a further feature of this invention to provide heated fresh ventilation air to accommodate for the decrease in oven temperature which occurs as a result of heat exchange with the component and internal oven parts.

It is a further feature of the present invention to provide cool ventilation air into a first radiant bring up zone so that infrared lamps may be utilized.

Another further feature of this invention is to provide an exhaust element between a last bring up zone and a first convection air holding zone such that the maximum solvent concentration occurs at points in the oven furthest from the entrance and exit ends.

BRIEF DESCRIPTION OF THE DRAWINGS

The objects and features of the invention will become apparent from a reading of the detailed description taken in conjunction with the drawings, in which.

DETAILED DESCRIPTION OF A PREFERRED EMBODIMENT

Figure 1:
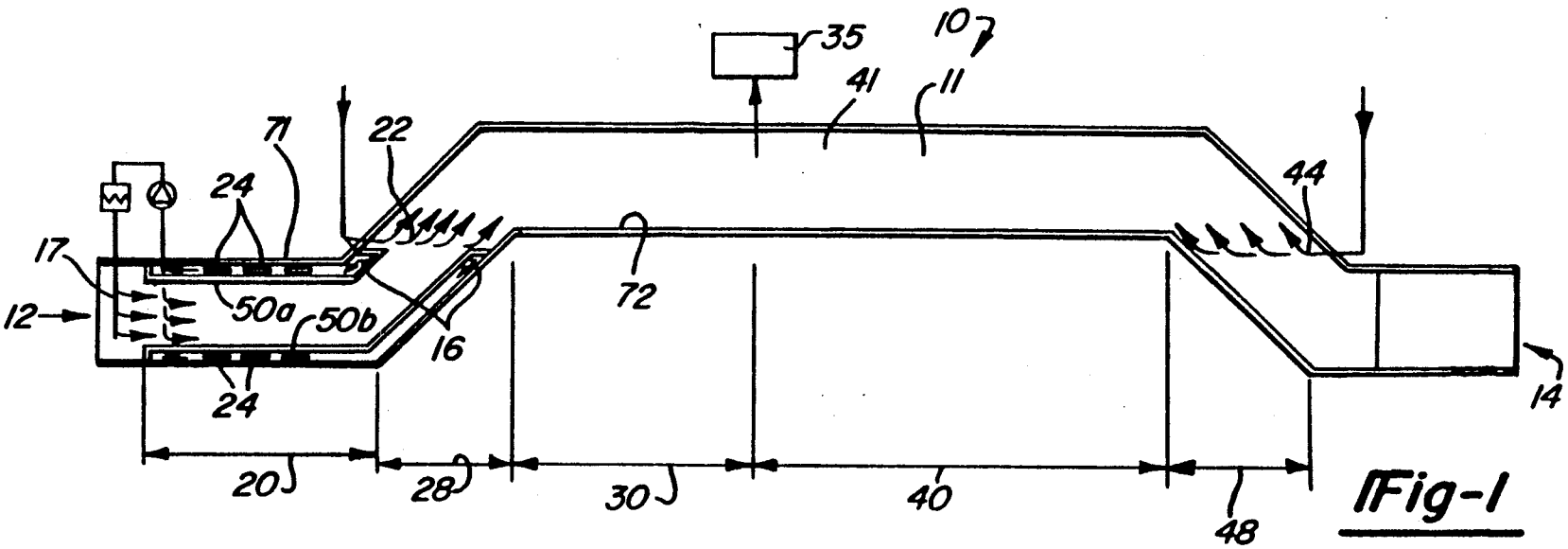
FIG. 1 is a cross-sectional side view of a paint baking oven of the camel-back design having exhaust means located between a first bring up zone and a convection air holding zone.
Figure 2:
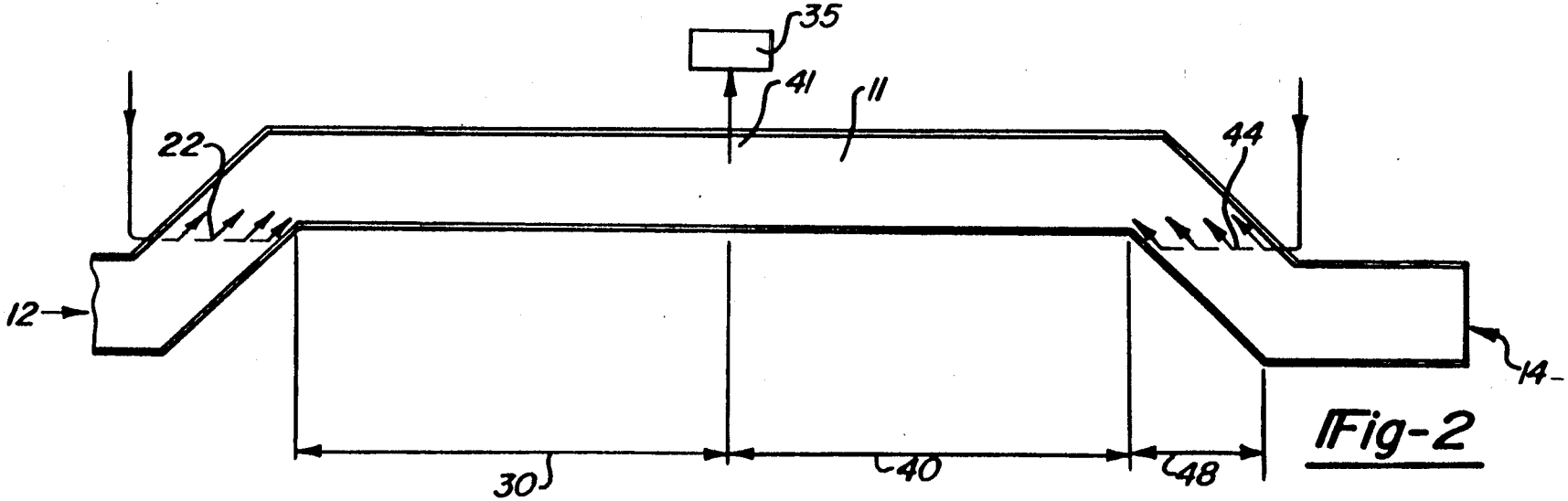
FIG. 2 is an expanded cross-sectional side view of the camel-back paint baking oven of FIG. 1.

With reference to FIGS. 1 & 2, a camel-back paint baking oven 10 in the form of an elongated tunnel having first and second end sections separated by an extending hump 11 located above the two end sections is shown in cross section. Beginning at the sealed entrance end 12, the articles to be baked move upon a conveyor (not shown) longitudinally along a path of travel parallel to the longitudinal axis of the zone or section through which the component is passing. The camel-back paint baking oven 10 of FIGS. 1 & 2 includes a first radiant bring up zone 20 located proximate to the entrance end 12, an inclined transition area 28 leading to an elevated convection bring up zone 30, an elevated first convection air holding zone 40 located within the oven hump portion 11 within which the components are baked by a chemical reaction and a declining transition zone leading to the exit end 14 of the oven. Also included on the camel-back paint baking oven 10 are a plurality of air inlets 17, 22 and 44 for introducing ventilation air into the camel-back paint baking oven 10 and exhaust means 35 located between the bring up zone 30 and the convection air holding zone 40 which provides a passageway to an incinerator.

Initially, the component enters the camel-back paint baking oven 10 on a conveyor through an air sealed silhouette (not shown) located at the entrance end 12 of the camel-back paint baking oven 10. Once inside the camel-back paint baking oven 10, the component passes into and through a first oven section referred to herein as the first radiant bring up zone 20. In the camel-back type paint baking oven 10, the upper surface or ceiling 71 of first radiant bring up zone 20 is situated at least 0.5 meters below the lower surface of floor 72 of the elevated convection air bring up zone 30. This height differential of at least 0.5 meters provides the camel-back paint baking oven 10 with a thermal lock which helps reduce leakage out of hot air and leakage in of cold air, thereby reducing the occurrence of undesirable condensation of solvents and/or resins at the air seals 17, 22 and 44.

Within first radiant bring up zone 20, radiation is applied to a painted component (not shown) to quickly raise the component temperature to a desired level in preparation for the paint baking which occurs by chemical reaction within the convection air holding zone 40. The source of radiation within first radiant bring up zone 20 may, in general, be either dark radiation panels or infrared lamps. When infrared lamps 24 are utilized, ventilation air must be introduced into the first radiant bring up zone 20 to cool the infrared lamps which cannot operate under standard paint baking oven conditions. Therefore, cool fresh ventilation air is introduced as shown by arrows 16 behind quartz glass walls 50*a* and 50*b* which isolate the infrared lamps 24 from hot air in the bring-up zone 20. The cooling air sweeps through and cools the infrared lamps 24. Typically, fresh ventilation air is injected through the air inlet seals 17 at a velocity of between 0.5–1.5 meters per second (m/s) to avoid the creation of turbulence within the radiant bring up zone 20. As the component temperature is raised within first radiant bring up zone 20, solvents and/or resins tend to evaporate from the component and pass into the ventilation air stream. The ventilation air stream then carries the evaporated solvents and/or resins further within the camel-back paint baking oven 10 toward the middle thereof.

The ventilation air passes completely through the first radiant bring up zone 20 and flows into the inclined transition zone 28 where the component is raised up into the elevated hump portion 11 of the camel-back paint baking oven 10. Additional air seals 22 are provided at approximately the halfway point on transition zone 28 for introducing additional heated ventilation air into the camel-back paint baking oven 10. This additional heated ventilation air which enters the camel-back paint baking oven 10 through air seals 22 typically has a temperature significantly higher than the temperature of the air already contained in the camel-back paint baking oven 10 to compensate for the heat exchange which occurs between the oven air and the component and infiltrating cooler air entering from lower portions of the camel-back oven. For example, if the camel-back paint baking oven temperature is required to be 150° C. to sufficiently bake the component, the heated fresh ventilation air will typically be between 200°–250° C. to compensate for any heat exchange which occurs.

The heated fresh ventilation air which is introduced at air seals 22 is introduced above the oven zone equilibrium point which is the point within the oven where the ventilation air draft naturally moves upwardly from the transition zone 28 to the succeeding oven zones when contacted by the cooler air from the first radiant bring up zone 20.

Extending above the camel-back paint baking oven 10 between the trailing end of the bring up zone 30 and the convection air holding zone 40 are exhaust means 35 through which the solvent and/or resin laden air leaves the camel-back paint baking oven 10. The exhaust means 35 generally include a single horseshoe or U-shaped exhaust duct through which the air from the camel-back paint baking oven 10 is withdrawn and sent to an incinerator (not shown) where the solvents and/or resins are burned off prior to releasing the exhausted air into the atmosphere. It will be understood by those skilled in the art that the exhaust means may be of varying designs.

Heated fresh ventilation air is also introduced through seal 44 located approximately at the halfway point on a second inclined transition zone 48 above an oven equilibrium point near exit end 14.

The heated fresh ventilation air, which is introduced through air seal 44, rises to the top of the transition zone 48 and into the convection air holding zone 40 toward the middle of the paint baking oven 10.

Again, this fresh ventilation air introduced through air inlet 44 near the exit end 14 of the camel-back paint baking oven 10 has a temperature which is greater than the oven temperature to accommodate for heat loss resulting from contact with the component and the internal oven parts. This heated fresh ventilation air introduced near the exit end 14 of the camel-back paint baking oven 10 is provided so that no condensation of solvents or resins will occur in this area of the oven.

Once heated ventilation air reaches the leading end 41 of the convection air holding zone 40, it is exhausted via duct 35 and incinerated prior to being released into the atmosphere.

To maintain an even flow of ventilation air supplied to the paint baking oven 10, the total volume of air introduced into the paint baking oven 10 through the various air seals 17, 22 and 44 can be monitored and controlled by attaching apparatus such as a venturi tube to the exhaust means 35.

Figure 3:
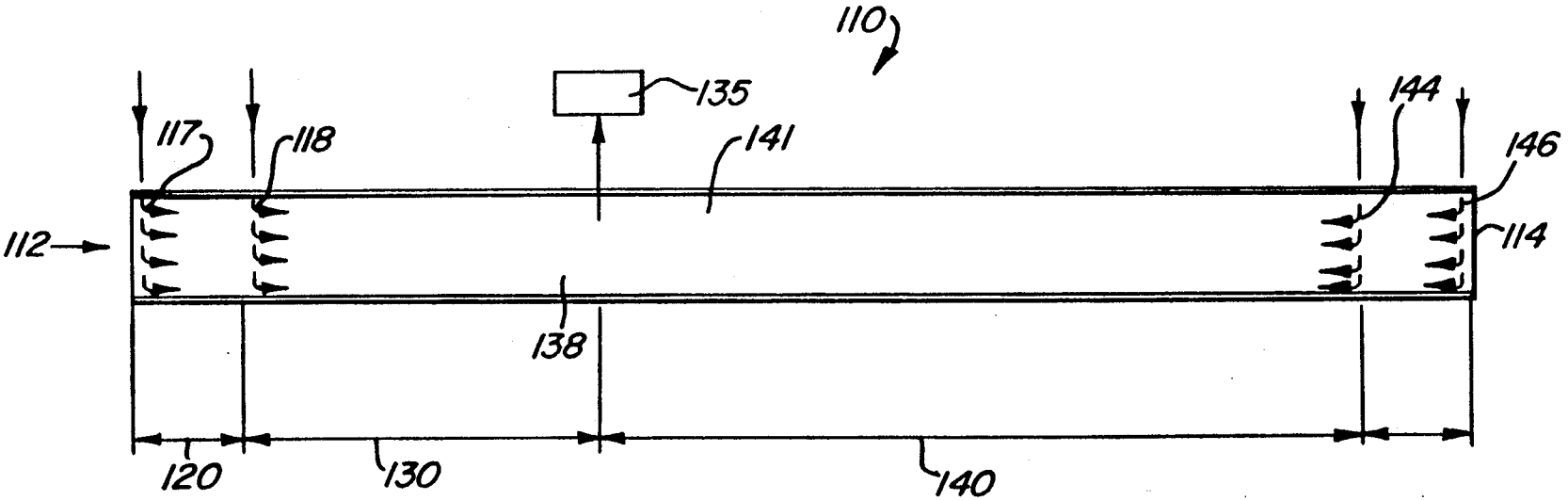
FIG. 3 is a cross-sectional side view of a paint baking oven of the straight through design having exhaust means located between a first bring up zone and a convection air holding zone.

With reference to FIG. 3, a straight through paint baking oven 110 in the form an elongated tunnel having first and second end sections 112 and 114, respectively, and a middle section comprising a bring up zone 130 and a convection air holding zone 140 is shown in cross section. Beginning at the entrance end 112, the articles to be baked move upon a conveyor (not shown) longitudinally along a path of travel parallel to the longitudinal axis of the paint baking oven 110. The straight through paint baking oven 110 of FIG. 3 includes first and second air seals 117 and 118, located proximate to the entrance end 112 of the straight through paint baking oven 100, a bring up zone 130, a convection air holding zone 140, and third and fourth air seals 144 and 146 located proximate to the exit end 114 of the paint baking oven 110. Also included as part of the straight through paint baking oven 110 are exhaust means 135 located between the first bring up zone 130 and the convection air holding zone 140 which provide a passageway to an incinerator (not shown).

Initially, the component enters the straight through paint baking oven 110 on a conveyor through an air sealed silhouette (not shown) located at the entrance end 11 of the straight through paint baking oven 110. Once inside the straight through paint baking 110, the component passes into and through a first oven section, referred to herein as bring up zone 120. Within first bring up zone 120, radiant heat is applied to the component through dark radiation panels to raise the component temperature to the desired level in preparation for the more intensive paint baking which occurs by chemical reaction within the convection air holding zone 140.

Solvents and/or resins generally evaporate from the component during the paint baking process. To prevent condensation of any evaporated solvents and/or resins heated fresh ventilation air is introduced into the paint baking oven 110 through air seals 117 and 118. While a single air seal, such as 117, is believed satisfactory, it has been found that a pair of air seals 117 and 118 is preferable. This ventilation air sweeps the evaporated solvents and/or resins toward the exhaust means 135 provided at the center of the paint baking oven 110. Typically, this heated fresh ventilation air has a temperature which is approximately 50° C. higher than the temperature of the air already contained in the paint baking oven to compensate for the heat exchange which occurs between the oven air and the component and internal oven parts.

Extending from the straight through paint baking oven 110 between the trailing end 138 of the bring up zone 130 and the leading end 141 of the convection air holding zone 140 are exhaust means 135 through which the solvent and/or resin laden air leaves the straight through paint baking oven 110. The exhaust means 135 generally include a single horseshoe or U-shaped exhaust duct through which the ventilation air is withdrawn and sent via the air exhaust duct to an incinerator (not shown) where the solvents and/or resins are burned off prior to being released into the atmosphere. It will be understood by those skilled in the art that the exhaust means 135 may be of varying designs.

Heated fresh ventilation air is also introduced at the exit end 114 of the straight through paint baking oven 110 through air seals 144 and 146. Again, a pair of air seals is preferable, but not necessary. This fresh ventilation air also has a temperature which is greater than the oven temperature to accommodate for the heat loss which continually occurs throughout the straight through paint baking oven 110 as a result of heat exchange with the component and outside air which may infiltrate the oven at its entrance and exit ends. The heated fresh ventilation air is provided to avoid condensation of solvents or resins in the vicinity of air seals 144 and 146. Once this heated ventilation air, which has entered through air inlets 144 and 146, reaches the leading end 141 of the convection air holding zone 140, it too is exhausted via exhaust means 135 and incinerated prior to being released into the atmosphere.

To maintain a total volume of air introduced into the straight through paint baking oven 110 which is equal to the amount of air simultaneously being exhausted, a venturi tube can be incorporated at the exhaust means 135 to monitor and control the rate at which the air is exhausted from the straight through paint baking oven 110.

What is claimed:

1. A paint baking oven having a bring up zone and an adjacent additional zone located between an entrance and an exit end of the oven, with articles to be baked moving therethrough from the entrance end to the exit end, means for continuously ventilating said paint baking oven including a plurality of air inlets for introducing substantially all ventilation air into the oven in a direction substantially parallel to a direction of movement of the articles to be baked, at least one air inlet being located at the entrance end and at least one air inlet being located at the exit end for introducing the ventilation air into the oven is substantially opposite directions; at least a portion of said ventilation air being heated to provide the baking function of said paint baking oven and exhaust means extending from said paint baking oven between said bring up zone and said additional zone for removing ventilation air.

2. A method of ventilating a paint baking oven having at least one bring up zone at a first end and at least one additional zone at a second end comprising steps of:

(a) continuously introducing substantially all ventilation air into the oven through at least one air inlet at the first end and at least one air inlet at the second end such that the ventilation air is directed toward an oven central portion in opposite directions substantially parallel to longitudinal axes of the bring up and additional zones; at least a portion of said ventilating air being heated to provide the baking function of said paint baking oven and (b) continuously exhausting the ventilation air from the oven through exhaust means positioned to extend from the oven between the at least one bring up zone and the additional zone to allow for a steady flow of fresh ventilation air to pass into and through the paint baking oven from both ends thereof.

3. A camel-back paint baking oven having a first bring up zone, an inclined transition zone leading to a centrally located elevated hump portion containing a convection air bring up zone and a convection air holding zone, a declining transition zone leading to a paint baking oven exit, a top surface of said first bring up zone located on a substantially parallel plane below a bottom surface of said hump portion, and means for continuously ventilating said paint baking oven including air inlets located at an entrance of said paint baking oven and on both the inclining and declining transition zones for introducing ventilation air into the oven toward a central portion thereof, and exhaust means extending from said paint baking oven between said convection air bring up zone and said convection air holding zone.

4. The camel-back paint baking oven of claim 3 wherein said first bring up zone includes a plurality of infrared lamps which are operative to radiantly increase the temperature of an article to be baked.

5. The camel-back paint baking oven of claim 3 wherein said ventilating air introduced at the entrance end of the paint baking oven is injected horizontally with a velocity of between 0.5–1.5 meters per second (m/s) to avoid creation of turbulence within the first bring up zone.

6. The camel-back paint baking oven of claim 3 wherein the ventilating air introduced at air seals contained on the transition zones is introduced above an oven zone equilibrium point.

7. The camel-back paint having oven of claim 3 wherein said top surface of said first bring up zone is located on a parallel plant at lest 0.5 meters below said bottom surface of said hump portion.

8. The camel-back paint baking oven of claim 7 wherein the ventilating air introduced at air seals contained on the transition zones is introduced above an oven zone equilibrium point.

9. The camel-back paint baking oven of claim 7 wherein said first bring up zone includes a plurality of infrared lamps which are operative to radiantly increase the temperature of an article to be baked.

10. A method of ventilating a camel-back paint baking oven having a first bring up zone, an inclining transition zone connecting the first bring up zone to a centrally located hump portion containing a convection air bring up zone and a convection air holding zone, a declining transition zone leading to a paint baking oven exit, and a top surface of said first radiant bring up zone is located on a substantially parallel plane below a bottom surface of said hump portion, the method comprising:

(a) continuously introducing heated ventilation air through air seals positioned within the inclining transition zone of the paint baking oven;

(b) continuously introducing ventilation air into the first bring up zone through air seals positioned at an entrance end of said paint baking oven which combines with the ventilation air introduced through the air seals within the inclining transition zone to flow toward a center of the paint baking oven;

(c) continuously introducing heated ventilation air through air seals positioned within the declining transition zone wherein said ventilation air is directed into and through said convection air holding zone; and (d) continuously exhausting the ventilation air introduced in steps (a), (b), and (c) through exhaust means located between said convection air bring up zone and said convection air holding zone.

11. The method of claim 10 wherein said ventilating air introduced through air seals at the entrance end of the paint baking oven is injected horizontally with a velocity of between 0.5–1.5 meters per second (m/s) to avoid creation of turbulence within the first bring up zone.

12. The method of claim 10 wherein said top surface of said first radiant bring up zone is located on a parallel plane at least 0.5 meters below a bottom surface of said hump portion.

13. A straight through paint baking oven having a bring up zone and an additional zone located between an entrance end and an exit end with articles to be baked moving longitudinally therethrough, and means for continuously ventilating said paint baking oven including at lest one air inlet located at the entrance end of said oven and at least one air inlet located at the exit end of said oven for introducing substantially all ventilation air into the oven toward a center of the paint baking oven in opposed directions substantially parallel to movement of the articles to be baked, at least a portion of said ventilation air being heated to provide the baking function of said paint baking oven and exhaust means extending from said paint baking oven between said bring up zone and said additional zone.

14. A method of ventilating a straight through paint baking oven having at least one bring up zone and at least one additional zone located between an entrance end and an exit end of the oven with articles to be baked moving longitudinally therethrough, the method comprising:

(a) continuously introducing a first volume of ventilation air into the entrance end of said paint baking oven through at least one air seal;

(b) continuously introducing a second volume of ventilation air into the exit end of said paint baking oven through at least one air seal; the first plus the second volumes comprising substantially all of the ventilation air supplied to the oven, the first and second volumes being directed in opposite directions substantially parallel to longitudinal movement of the article, and (c) continuously exhausting the ventilation air through exhaust means extending from said paint baking oven between said baking up zone and said additional zone to allow for a steady flow of fresh ventilation air to pass into and through the paint baking oven from both ends thereof toward an oven central portion.

* * * * *

UNITED STATES PATENT AND TRADEMARK OFFICE

CERTIFICATE OF CORRECTION

PATENT NO. : 5,309,650

DATED : May 10, 1994

INVENTOR(S) : Leif E.B. Josefsson et al.

It is certified that error appears in the above-indentified patent and that said Letters Patent is hereby corrected as shown below:

Column 4, Line 51, "11" should be –112–.

Column 5, Line 57, Claim 1, "is" should be –in–.

Column 6, Line 48, Claim 7, "lest" should be –least–.

Column 7, Line 34, Claim 13, "lest" should be –least–.

Column 8, Line 30, Claim 14, "baking" should be –bring–. (second occurence)

Signed and Sealed this

Thirteenth Day of September, 1994

*Attest:*

Bruce Lehman

BRUCE LEHMAN

*Attesting Officer*

*Commissioner of Patents and Trademarks*